US009066567B2

(12) United States Patent
Rouzeau

(10) Patent No.: US 9,066,567 B2
(45) Date of Patent: Jun. 30, 2015

(54) LENS SHIELD PORTABLE EYEGLASSES FASHION ACCESSORY CASE

(71) Applicant: Philip Martin Rouzeau, Massapequa, NY (US)

(72) Inventor: Philip Martin Rouzeau, Massapequa, NY (US)

( * ) Notice: Subject to any disclaimer, the term of this patent is extended or adjusted under 35 U.S.C. 154(b) by 0 days.

(21) Appl. No.: 14/083,432

(22) Filed: Nov. 18, 2013

(65) Prior Publication Data

US 2014/0138264 A1 May 22, 2014

(51) Int. Cl.
*A45C 11/04* (2006.01)

(52) U.S. Cl.
CPC ..... *A45C 11/043* (2013.01)

(58) Field of Classification Search
USPC ..... 206/5, 6
See application file for complete search history.

(56) References Cited

U.S. PATENT DOCUMENTS

| | | | | |
|---|---|---|---|---|
| 3,921,797 | A * | 11/1975 | Platt | 206/5 |
| 4,290,522 | A * | 9/1981 | Takasaki | 206/5 |
| 4,863,013 | A * | 9/1989 | Eastman | 206/5 |
| 4,953,695 | A * | 9/1990 | Tallman | 206/5 |
| 4,984,682 | A * | 1/1991 | Cummins | 206/5 |
| 5,032,019 | A * | 7/1991 | Burchett | 351/158 |
| 6,820,739 | B1 * | 11/2004 | Spitzer | 206/5 |
| 7,762,511 | B1 * | 7/2010 | Liebers et al. | 248/309.1 |
| 8,286,882 | B2 * | 10/2012 | Norman et al. | 235/487 |
| 2009/0000964 | A1 * | 1/2009 | Orner | 206/5 |
| 2009/0057165 | A1 * | 3/2009 | Park et al. | 206/6 |
| 2013/0248384 | A1 * | 9/2013 | Klein | 206/5 |

* cited by examiner

*Primary Examiner* — Jacob K Ackun

(57) ABSTRACT

A spectacle case that optimizes portability, ease of folding, adequate spectacle protection, lens cleaning ability, & usability as a fashion accessory that can clip anywhere on your clothing, while also minimizing manufacturing labor & costs.

18 Claims, 9 Drawing Sheets

LENS SHIELD PORTABLE EYEGLASSES FASHION ACCESSORY CASE

CROSS-REFERENCE TO RELATED APPLICATIONS

Figure 1:
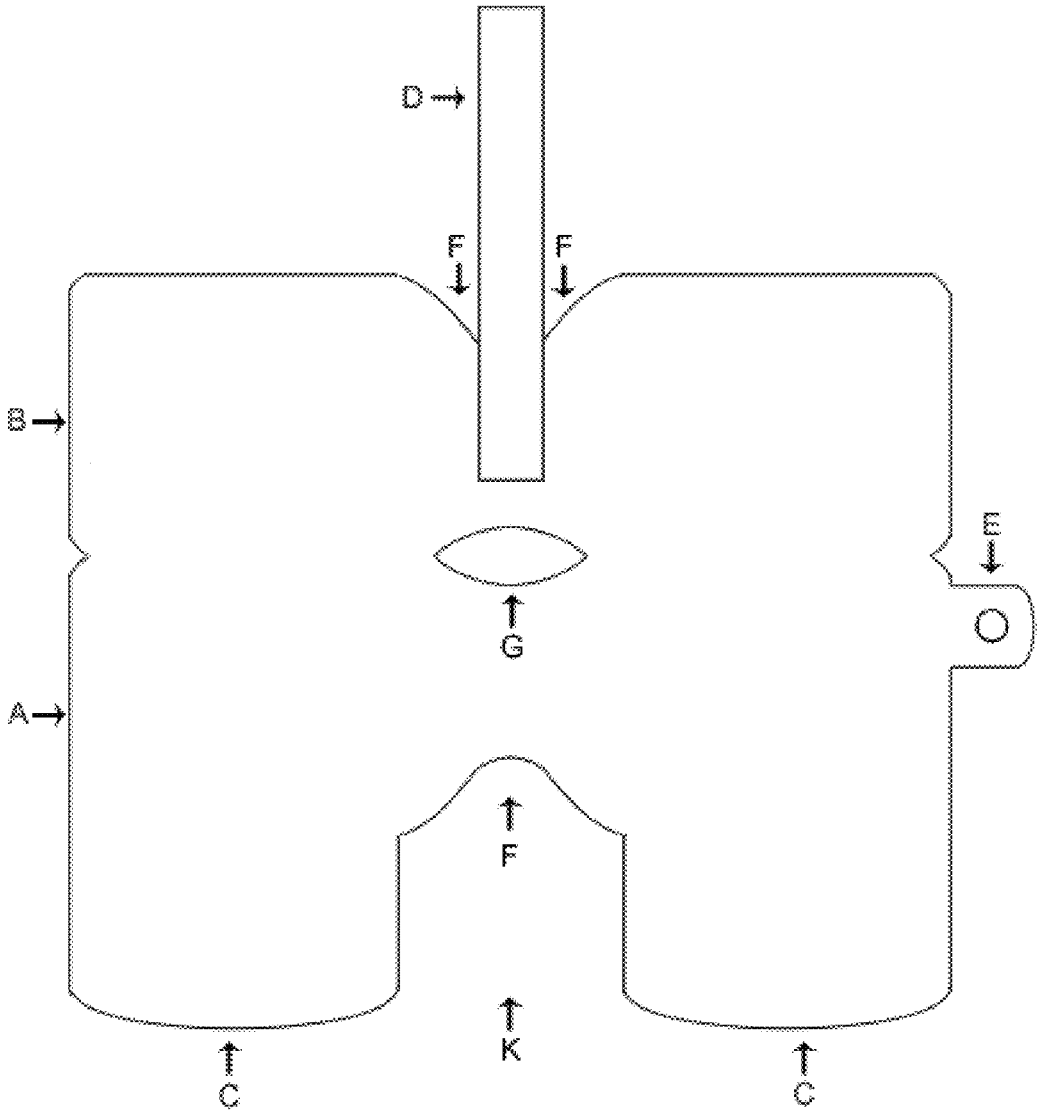

U.S. Provisional Patent Reference No. 61/728,011, Title: Lens Shield

BACKGROUND

Presented is an invention for a spectacle case that optimizes portability, & fashion without sacrificing adequate spectacle protection that can also clean your lenses & allow your encased spectacles to be worn as a fashion accessory anywhere on your clothing.

Prior spectacle cases lack the necessary functional design & shape to provide & optimize the main features of this invention which are; fashion, portability, ease of folding, adequate spectacle protection, & lens cleaning ability.

Many prior cases for spectacles encase the entire frame. While encasing the whole frame provides good spectacle protection it also hinders portability & fashion. This is because the large space between the back of the lenses & the temples when they are closed makes encasing the whole frame require a bigger & bulkier case.

In recent times there have been inventions that have addressed the issue of case bulkiness by encasing only the front area of a frame and not the temples. However, these current inventions still lack in areas of optimizing clothing fashion accessory ability, security for the temples, & extra portability features such as ease of folding & flexible free moving clipping ability anywhere on your clothing.

Some of the prior inventions that encase only the front area of a frame and not the temples have a hard shelled exterior. These inventions are impractical due to the varying curvature of the front of the frames especially as it pertains to sunglasses. To be able to universally match a variety of spectacle frames with varying front curvature; a case that only protects the front of the frame needs to be made of a soft flexible material that can also curve along with the front of the spectacle frame. However, by using soft flexible material you sacrifice some protection. For a soft case to provide adequate protection it needs to include a layer of cushion that at a minimum spans the entire area of the lenses. To provide adequate protection it also needs a mechanism to keep the temples secured in a closed position.

In order to optimize a case to be easily foldable & fashionable there needs to be a narrow bendable middle nose section of the case with nose bridge indentations that mimics the space between the lenses above &/or below the bridge of a spectacle frame. These nose bridge indentations will give the case the fashionable contoured look & style of a pair of spectacle frames; while also decreasing the material in the middle of the case so that it can fold easily down a center vertical axis.

However, with cases that only encase the front of a spectacle frame this center nose section of the case is the most optimum place to attach a strap to keep the temples closed. By removing material and creating nose section indentations in the center of the case you are also removing & limiting the area where a temple strap can be placed or attached in that area. This invention for a spectacle case solves this conflict and allows you to create fashionable nose section indentations in both the front & back panels of the case; while maintaining the ability to have a temple strap in that area.

Prior case inventions that encase only the front lens portion of a frame and not the temples also have a singular flap that traverses the entire horizontal width of the case, which can fold over & attach the front and back panels of the case together to keep them closed. This singular type of flap is deficient because it increases the amount of material in the middle of the case & it blocks the nose bridge indentations from being open & clear when the flap is closed, which makes the case less contoured & fashionable looking. By cutting away a space in the middle of this flap and converting the single flap into two separated flaps you simultaneously decrease the amount of material in the middle of the case, make the case easier to fold, & make it more fashionable.

Prior cases also have a deficiency in the type of clipping device used. Prior cases use clipping devices that can only clip to your pant waistband, belt loop, or pocket. These prior clipping devices can not easily grab & hold onto a fabric of clothing in any area. The problem with these prior clipping devices is that women do not always wear pants or clothing with pockets & it limits the area where the case can be fashionably clipped to be seen as an accessory that matches your outfit. Additionally, many prior clips lack the free moving flexibility to bend & twist in order to conform to the body movements of the wearer. Moreover, many prior spectacle case clipping devices are attached very close or directly onto the main body of the case. This inhibits free moving flexibility & it does not allow the clip to double as a device the can be used to keep the case folded in half.

Prior cases also lack the ability to serve a double function as a cleaning tool for your lenses. The rigidity of hard cases makes them not useful for cleaning your eyeglass lenses. Additionally, prior soft cases that have multiple permanently close side edges can not be opened to clean the lenses of your glasses with the soft interior fabric side of the case. This will force you to have to manually invert the eyeglasses case to bring the interior side out to clean your lenses or the exterior of the case will need to be made out of a material suitable to clean your lenses. By making the exterior of the case with material suitable to clean your lenses you limit the options that you have to make the exterior of the case look fashionable. This would preclude having material such as fashionable leather or vinyl on the exterior or fashionable items such as rhinestones laminated to the exterior of the case.

INVENTION SUMMARY

This invention is for a spectacle case that is fashionably contoured, space saving, smaller, lighter, easier to fold, more portable & convenient to carry with you. This specially designed case also gives you the ability to clip your encased spectacle as a fashion accessory anywhere on your clothing & can freely bend, twist & turn along with user movement. Additionally, this case also maintains adequate protection for the spectacle lenses & keeps the spectacle temples securely closed. Moreover, this case can also be used as a tool to clean your frame lenses.

This case invention includes a multi-layered sheet of material that provides a fashionable exterior, padded cushioning, & a soft scratch protecting interior that can also be used to clean your lenses.

This layered sheet of material can fold in half along a middle horizontal axis. The top half panel of the sheet will fold over the back of the frame's lenses between & underneath the temples. The bottom half panel of the sheet will fold over the front of the lenses.

This case also has a unique way of closing the top & bottom halves together. It incorporates the use of two flaps separated by a space between them in the middle. One flap is located on the left most side of the bottom half panel & the other is located on the right most side of the bottom panel. These flaps can fold over & attach to the exterior side of the top panel. Prior cases use a single flap that traverse the entire horizontal width of the case. Having dual flaps that are separated by a space in the middle is more advantageous because there is less material in the middle of the case. Having less material in the middle of the case makes the case easier to fold along a vertical axis down the center nose bridge area of the case.

By cutting out nose bridge indentations in the middle of the case that mimic the space above & below the nose bridge of a spectacle frame, we also reduce the amount of material in the middle of the case. This provides fashionable contoured styling to the case & also enhances the case's ability to fold down a vertical axis in the middle of the case. The ease of folding the case makes it more portable & easy to carry in your pocket.

This case invention also has a more advantageous temple strap than prior cases which encase only the front lenses of a frame. This case features a dual fastening strap that can fasten or unfasten at either end of the strap. This strap can attach to the interior of the top panel, extend out of the nose bridge opening, loop up over the temples, & fasten to the exterior side of the top panel. This strap design allows you to have middle nose bridge cutouts while keeping the ability to place a temple strap in the center. This allows the case to easily fold vertically down the center & it simultaneously protects the temples.

This case also features a clip with a mouth the can easily open or close to grab & hold anywhere onto a fabric of clothing. This clip can be remotely attached to the case by a string, chain or other device that can allow the case to freely spin, twist, turn, or bend along with user movement. This clip solution allows you to clip your encased eyewear as a fashion accessory anywhere on your attire even if your outfit does not have pants, pockets, or a belt. This clip solution will also serve a double function as an attaching mechanism that can be used to keep your case closed down a middle vertical axis.

REFERENCE TO DRAWINGS

FIG. 1—Interior Side of case fully open with a removable strap attached

Figure 2:
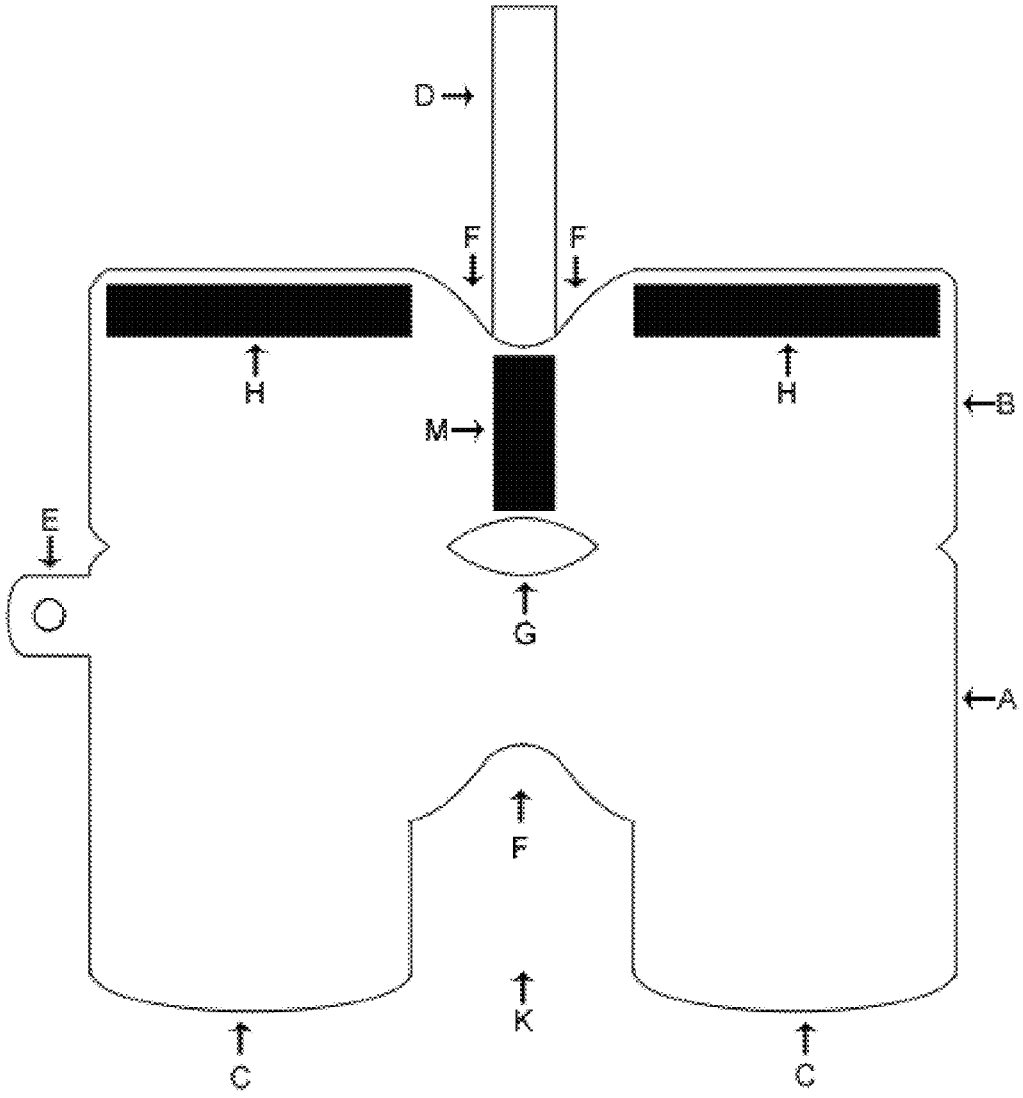

FIG. 2—Exterior Side of case fully open with removable strap attached

Figure 3:
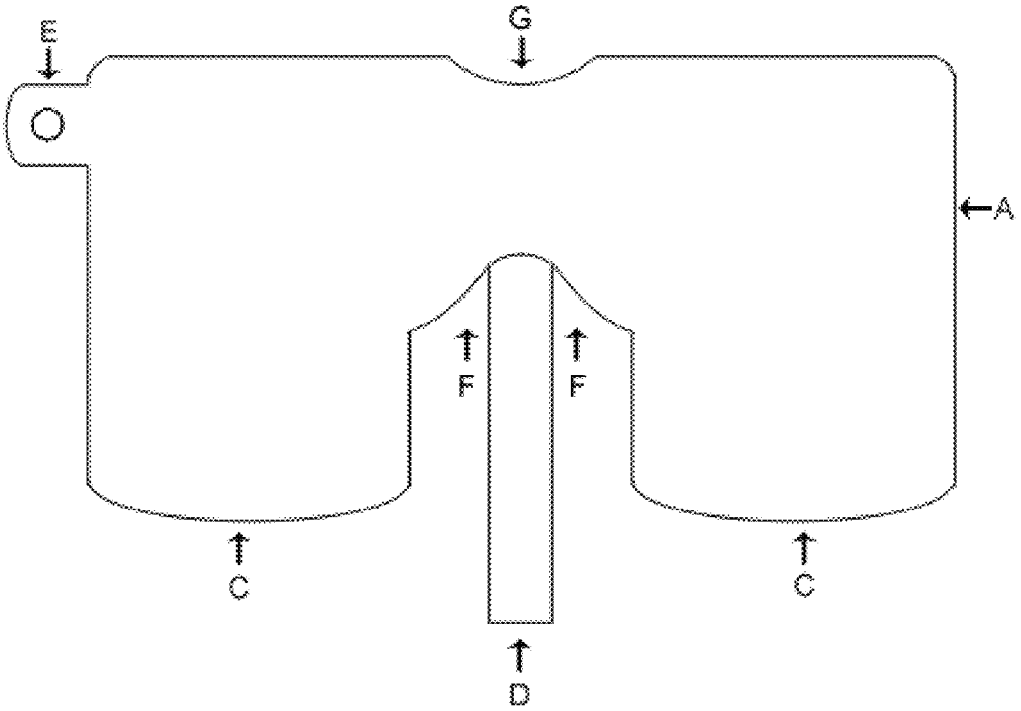

FIG. 3—Front view folded in half horizontally with flaps and strap open

Figure 4:
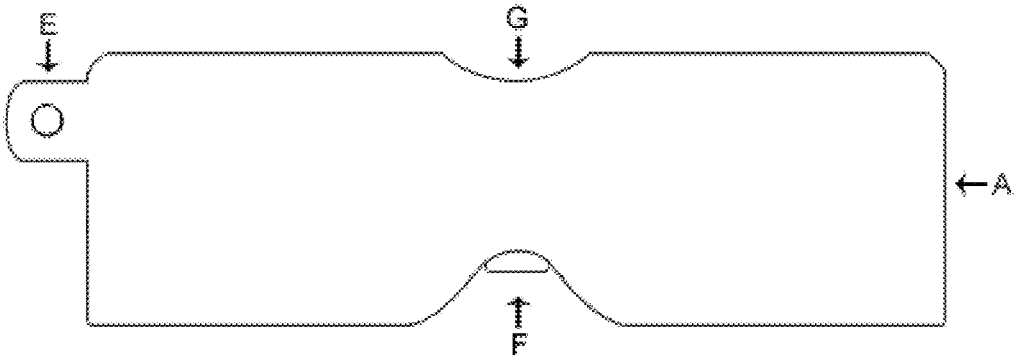

FIG. 4—Front view folded in half horizontally with flaps and strap closed

Figure 5:
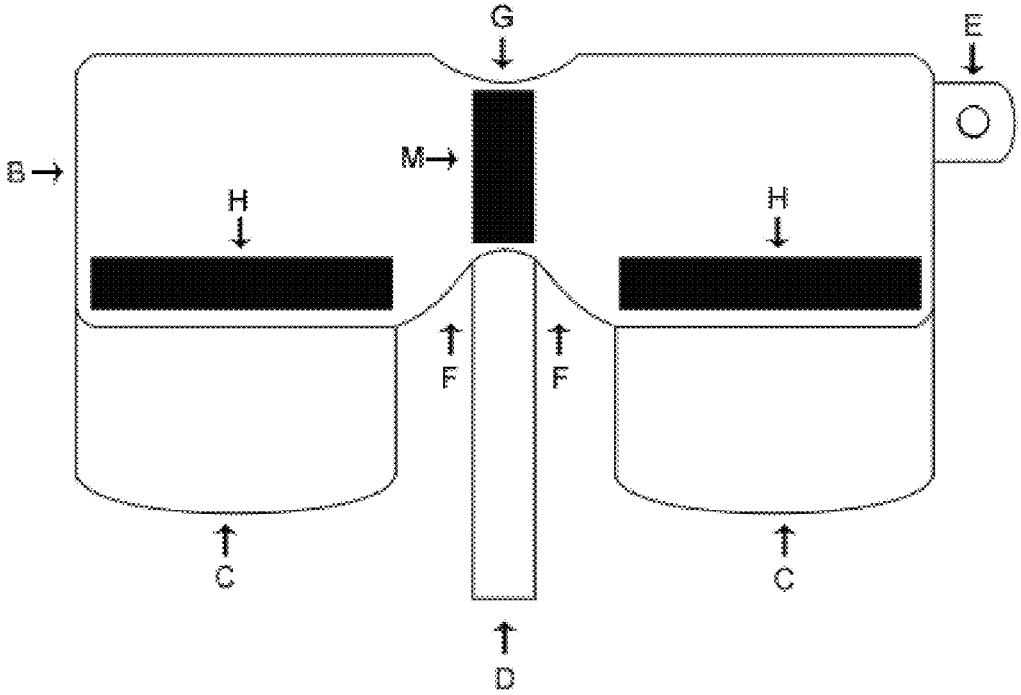

FIG. 5—Rear view folded in half horizontally with flaps and strap open

Figure 6:
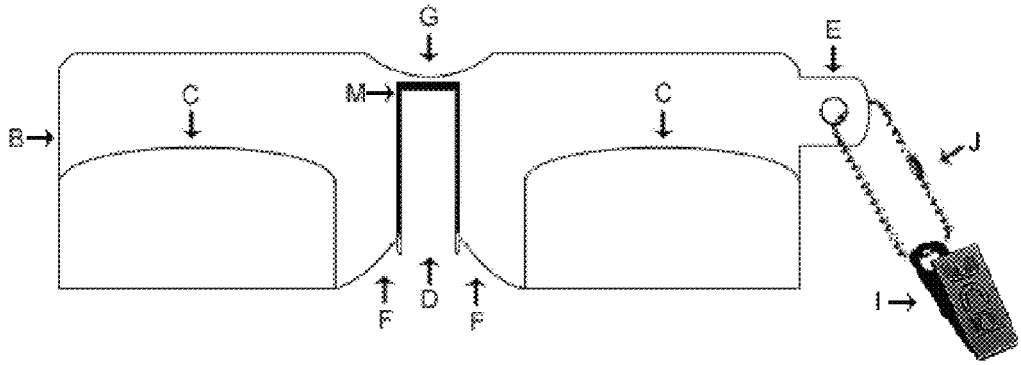

FIG. 6—Rear view folded in half horizontally with flaps and strap closed

Figure 7:
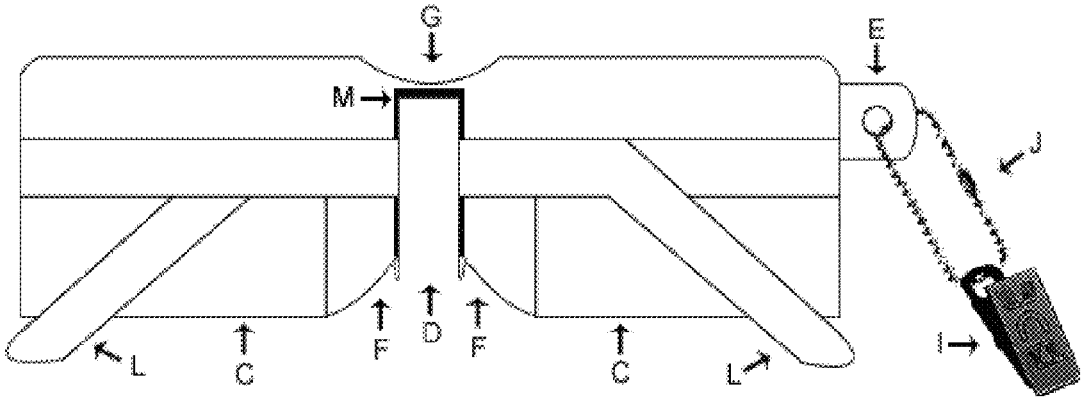

FIG. 7—Rear view of enclosed spectacles with the temples strapped down

Figure 8:
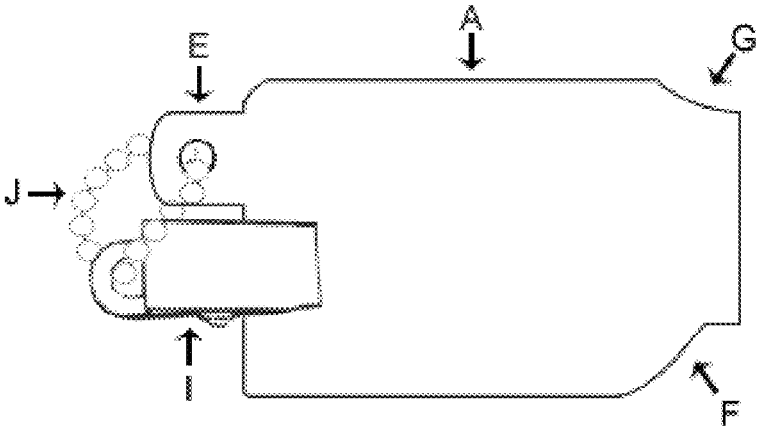
Figure 9:
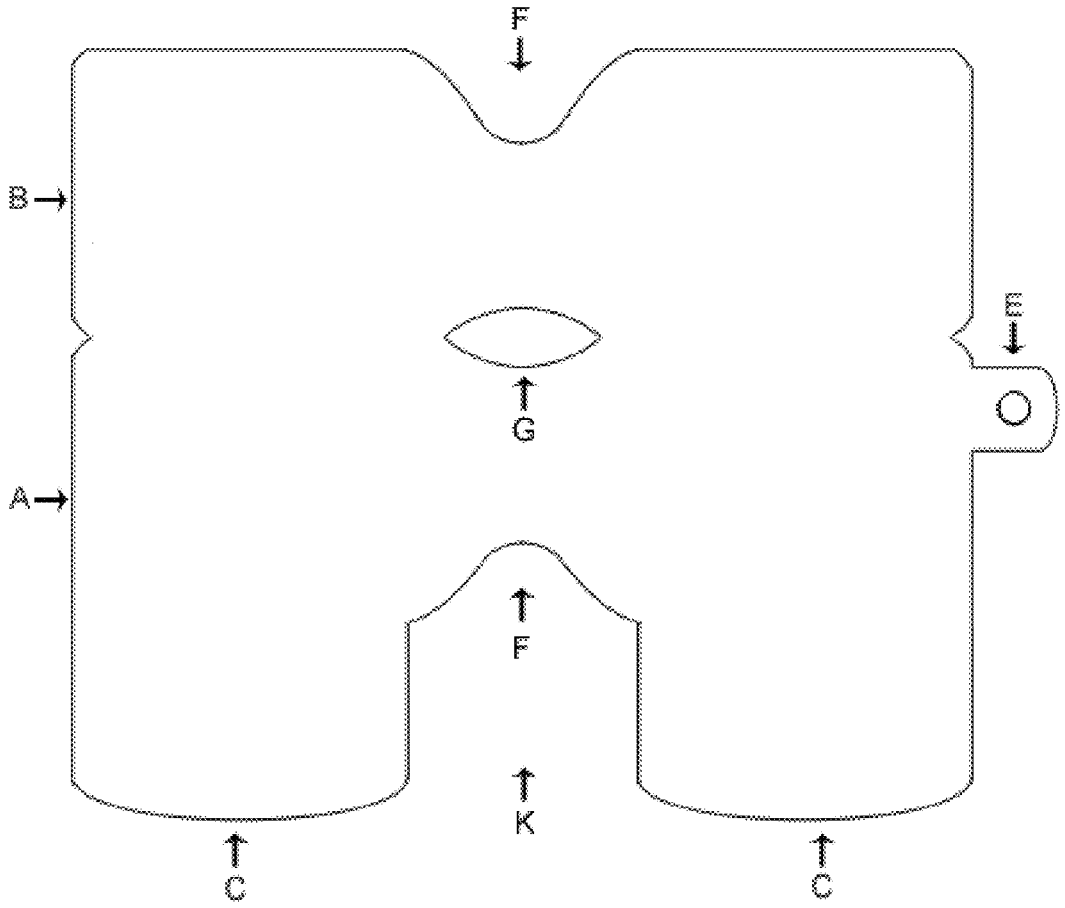
Figure 10:
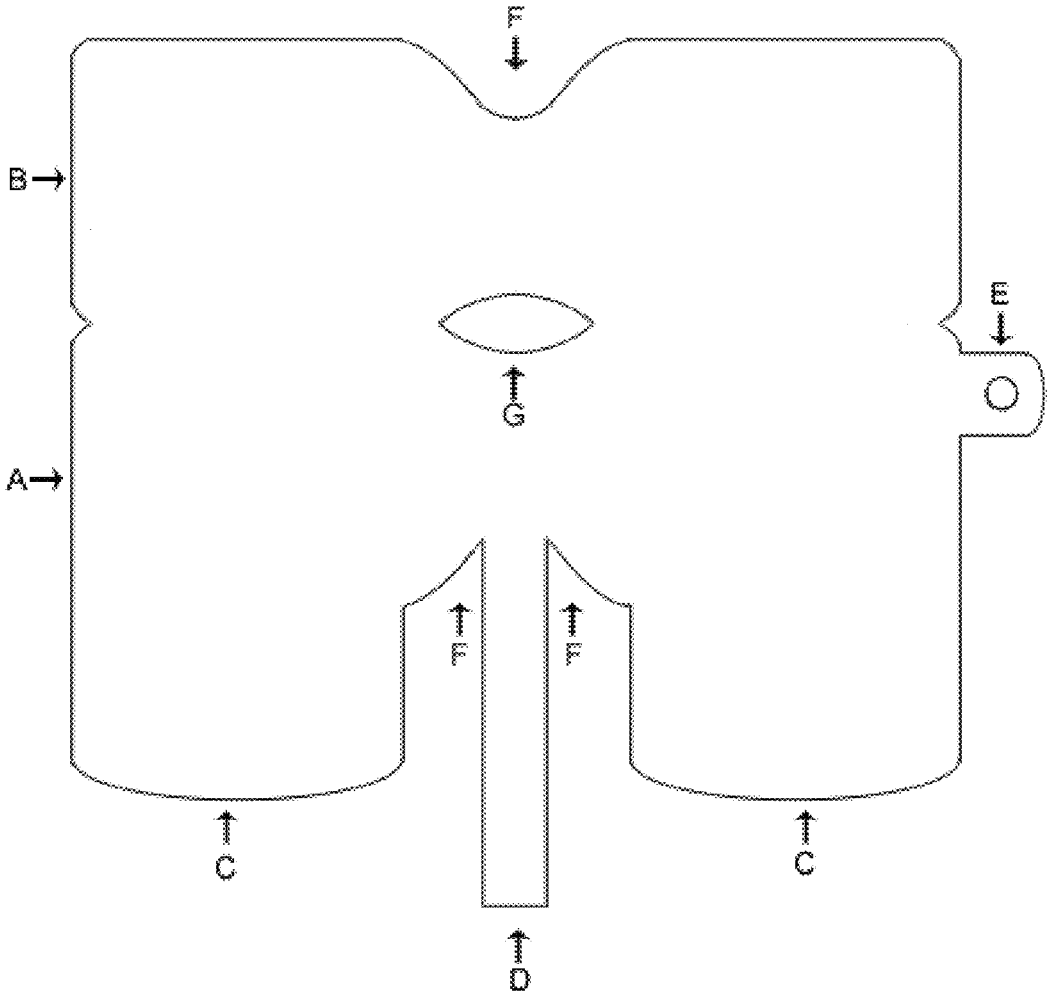
Figure 11:
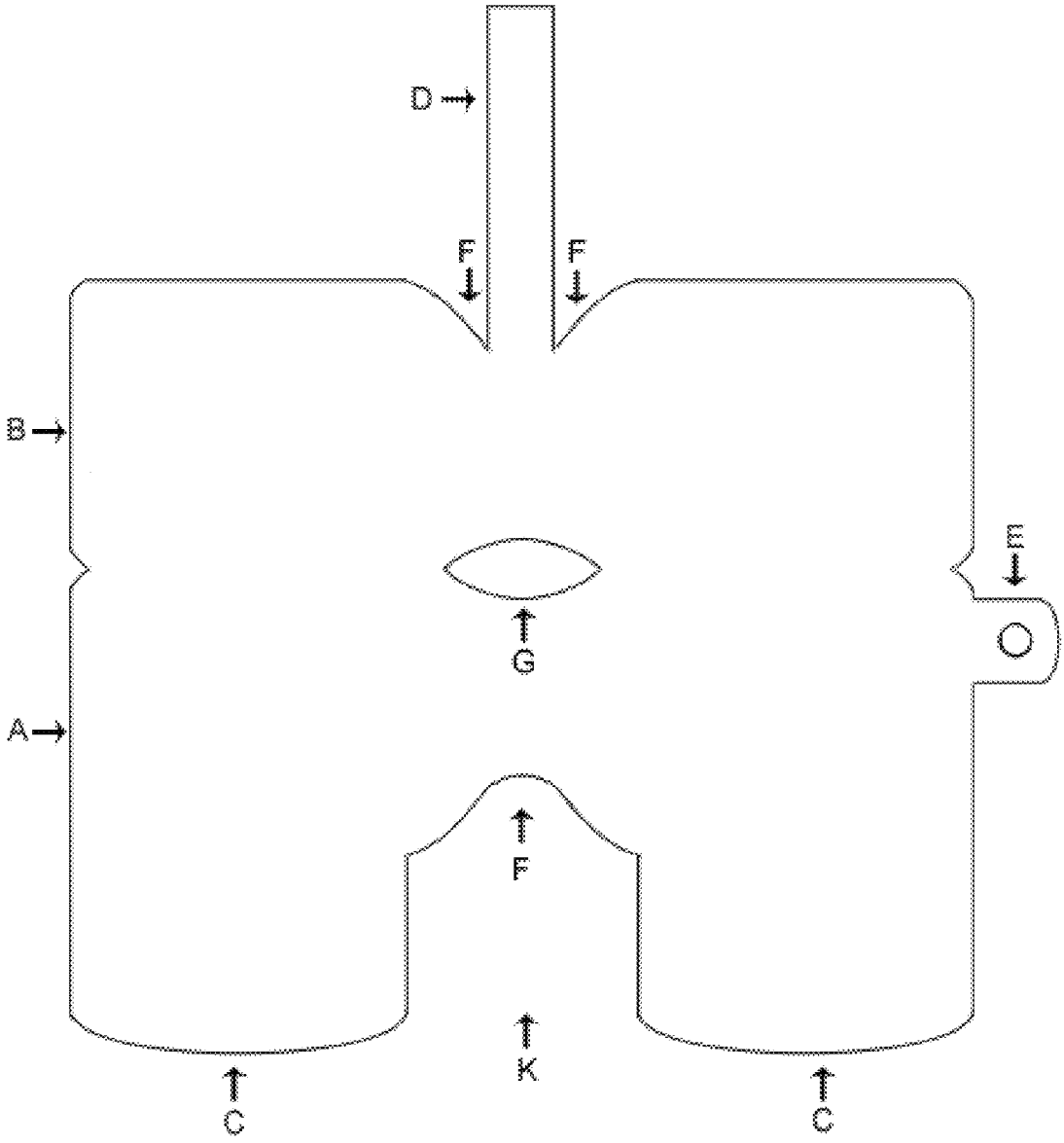
Figure 12:
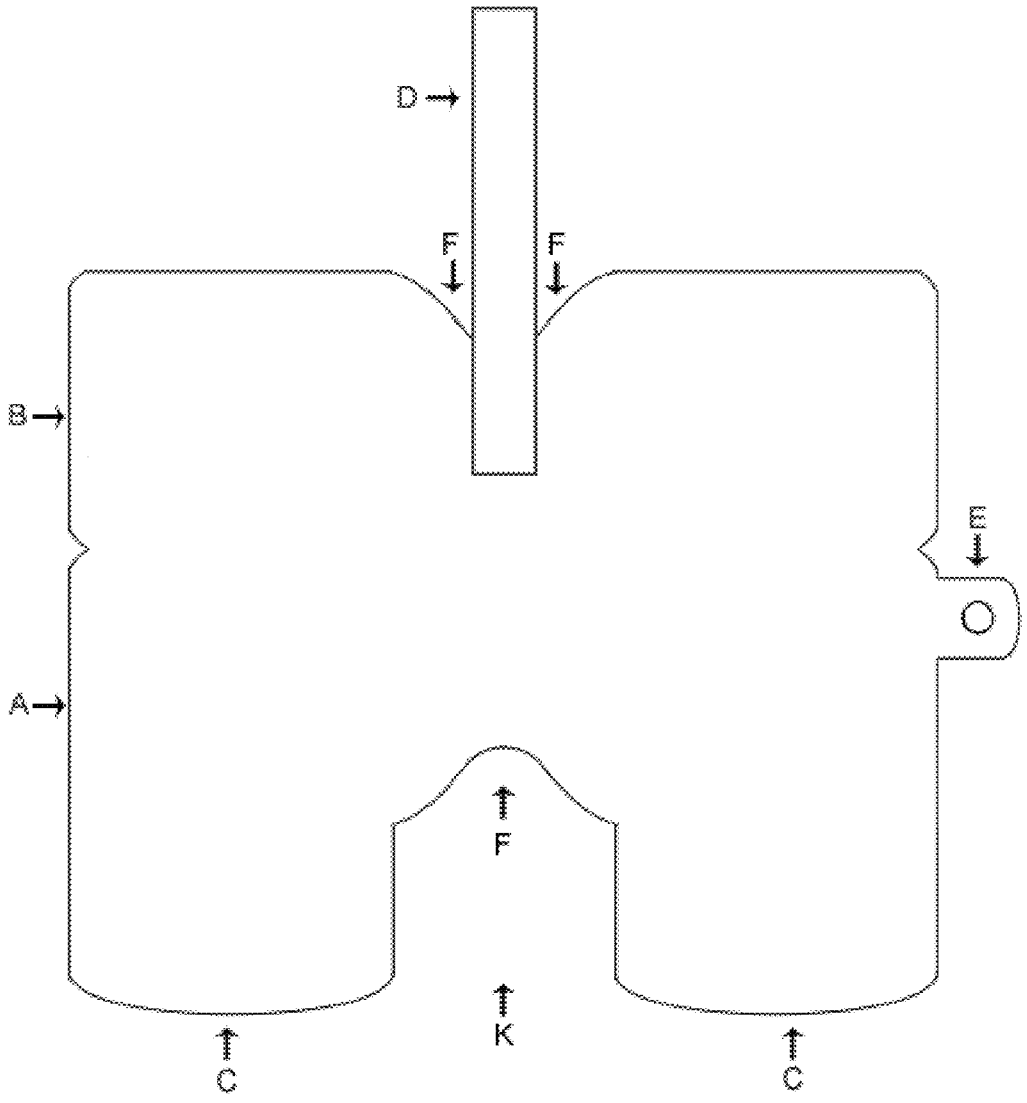

FIG. 8—Fully closed case that is folded in half vertically at the nose bridge FIG. 9—Interior side of case fully open with out the removable strap FIG. 10—Embodiment of open interior case with permanent strap on bottom nose bridge FIG. 11—Embodiment of open interior case with permanent strap on the top nose bridge FIG. 12—Embodiment of open interior case without an upper nose bridge indentation

REFERENCE CHARACTERS

A—Bottom Half Panel that covers the front side of the lenses

B—Top Half Panel that covers the back side of the lenses

C—Dual flaps separated by a space in the middle to close the case

D—Temple Strap that keeps temples securely closed

E—Tab with hole to attach a strap, string, chain and/or clipping device

F—Lower nose bridge indentations

G—Upper nose bridge elliptical eye shaped indentation

H—Attaching device such as Velcro to close the flaps

I—Clipping device with a mouth that can grab & hold anywhere on a fabric of clothing J—String, strap, or chain for remotely attaching the clip to the case K—Separating empty space between the dual flaps L—The temples of a spectacle frame M—Attaching device to close the temple strap

DETAILED DESCRIPTION

Presented is a spectacle case invention that optimizes portability, ease of folding, adequate spectacle protection, lens cleaning ability & usability as a fashion accessory that can clip anywhere on your clothing; while also minimizing manufacturing labor & costs.

This case invention is comprised of one or more layers of material that are permanently bonded together to form one singular flat sheet of material. The material can consist of one of more of the following layers; exterior, middle, & interior. The exterior layer can be a flexible material that will provide a fashionable finished look such as leather, vinyl, or a printable cloth material. The middle layer can consist of a flexible shock absorbing cushion layer such as foam or rubber. The interior layer can consist of soft flexible material that that can protect the lenses from scratches & also be used as a lens cleaning tool. Additionally, this interior layer can also be Velcro compatible. An example of a material that can protect against scratches, be used as a lens cleaning tool, & be Velcro compatible would be brushed nylon or unbreakable loop fabric.

This invention reduces the case size & increases portability by encasing only the front lens & bridge portion of the spectacle frame. The case will consist of top (B) & bottom (A) halve panels that can be folded over along a middle horizontal axis and slide over the front and back sides of the lenses of a frame. When folded over the lenses the top half panel (B) of the case will cover the back side of the lenses going between & underneath the temples (L); instead of going over the temples (L). The bottom half panel (A) of the case will cover the front side of the lenses.

The case will have a mechanism to close the bottom (A) & top (B) panels together in a way that enhances & does not inhibit the ability of the case to easily fold down a center vertical axis in the nose bridge area of the case. An embodiment of a mechanism to close the case are the use of dual flaps (C) located below the bottom panel (A) of the case. These flaps can be separated by a space in the middle (K), with one flap on the left most side of the bottom panel (A), & the other flap on the right most side of the bottom panel (A). This separating space (K) will decrease the amount of material in the middle of the case so the case can be easily folded down a center vertical axis as shown in (FIG. 8). These flaps can be folded over the exterior of the top half panel (B) between & underneath the temples (L) as shown in (FIGS. 6-7). These flaps can be held closed via an attaching mechanism (H) such as Velcro, buttons, snaps, or magnets.

The case will be able to maintain the fashionable form, shape and look of eyewear frames. This is accomplished by having contoured nose bridge indentations (F) located in the middle of both the top (B) and bottom (A) ends of the case. When the case is folded in half along a horizontal axis as shown in (FIGS. 3-7) the nose indentations will mimic the shape of the space below the bridge of a frame. The case can also have an elliptical eye shaped hole in the center (G). When the case is folded in half along a horizontal axis this hole will form an indentation that looks like the indentation above the bridge of a frame. An alternative embodiment of this invention without the upper nose bridge indentation is also shown in (FIG. 12). These contoured nose bridge cutouts will give the case the fashionable form, shape & look of eyewear frames when it is in the closed position (FIGS. 4, 6, & 7). Furthermore, these cutouts will create a very narrow nose bridge section of the case that will make it easier to fold the case along a vertical axis down the middle as shown in (FIG. 8). This will save space and allow you to carry the case in small spaces such as a pocket or clutch purse.

The case can also have a strap (D) to keep the temples closed. The lower nose indentation (F) creates an empty space below the temples (L). This prevents a strap from extending down from above the temple (L) & fastening below the temple (L) onto the exterior side of the top panel (B). Therefore, the strap (D) must extend out from the lower nose indentation (F) below the temple (L), & loop up & over the temple (L), & fasten above the temple (L) onto an attaching device (M) on the exterior top panel (B).

In one embodiment the strap (D) can be a permanent part of the shaped cut of the case material & extend out from either the top panel (B) or bottom panel (A) nose indentation (F) as shown in (FIG. 10) or (FIG. 11). The strap then can loop up over the temple (L), & fasten to the attaching device (M) on the exterior side of the top panel (B). However, this embodiment may cause an excess use of additional material to create the case. Additionally, it may create more waste fabric that can not be used & increase the cost per unit to manufacture the case.

In a second embodiment the case's shape can be cut without a permanent strap as shown in (FIG. 9). In this embodiment the strap (D) will be separate & will not have one end that is permanently attached to the case. The strap (D) will be able to fasten or unfasten at either end of the strap. This will allow the strap to be completely removable by the user should they desire not to have a strap. One end of the strap (D) will be able to fasten onto attaching device (M) on the exterior side of the top panel (B) above the temples (L). Because the material where the lower nose bridge indentation (F) has been cut away the other end of the strap can not fasten to the exterior side of the case in that location. This invention solves this problem by allowing the second end of the strap (L) to fasten to a Velcro compatible middle interior side of the top panel (B), instead of the exterior side of the case as shown in (FIG. 1). This will allow you to use Velcro as the material for your strap. One end of the Velcro strap can attach to the interior side of the top panel (B), then loop up over the temple (L) & fasten to attaching device (M) on the exterior side of the top panel (B) as shown in (FIG. 7).

This solution will allow you to maintain having your fashionably contoured nose bridge indentations (F) on both the front panel (A) & back panel (B) ends of the case; while still allowing you to attach a temple strap (L) in the center of the case. Furthermore, having a strap that can fasten & unfasten on both ends allows you to have both a removable strap & a strap that is adjustable in length as well. By fastening the Velcro strap closer to the middle horizontal axis on the interior side of the case your strap will be shorter & not extend out as much. Alternatively, by fastening the Velcro strap closer to the lower nose indentation (F) on the interior side of the case will cause the strap to extend out longer. This will allow there to be a greater length of strap to loop up over the temples (L) & attach to the exterior top panel (B) on attaching device (M). This creates a strap that can be adjustable in length & can universally match various different sizes of glasses.

This invention will also contain a tab (E) on the side of the case with an eyelet hole in it. This tab eyelet (E) will allow a clip (I) to be remotely attached to the case with a strap, rope, string, or chain (J). The chain (J) will allow the case to freely twist, turn or bend along with the body movement of the user. The clip (I) will have a mouth that can open and grab anywhere on a piece of fabric such as a spring loaded badge clip. This will allow the case to be worn anywhere the user desires on their attire and not just on the pant waistband, belt or pocket. This will increase the case's portability while also allowing the case to be used as a fashion accessory with all types of clothing, such as dresses or one piece woman's bathing suits that do not have a waistband, belt or pocket.

Furthermore, the length of the strap, rope, string or chain that remotely attaches the clip (I) to the case will be long enough so the clip can turn around & have its mouth face the body of the case. This will allow the clip (I) to be used as a device that can keep the case vertically folded closed at the center nose bridge section as shown in (FIG. 8). This embodiment or method for keeping the case vertically closed in half does not limit other embodiments, means or methods used to keep the case closed such as the use of buttons, snaps, or Velcro. However, giving the clip a double function to keep the case vertically closed in half will make adding a secondary means of keeping the case closed unnecessary. This will make the case easier & less costly to manufacture.

I claim:

1. A spectacle eyewear case configured to encase around the front & rear of the lens portion of a spectacle frame comprising a flexible flat sheet of material comprising;

A top panel; and

A bottom panel;

Wherein;

Said top and bottom panels fold over a middle horizontal axis traversing opposite sides of said sheet, wherein said top panel folds over the rear side of the lens portion of said spectacle frame between its two temple bows, and said bottom panel folds over the front side of the lens portion of a spectacle frame; and Wherein said sheet further comprises;

Two flaps, wherein one flap is located on the left side of said bottom panel and the other flap is located at the right side of said bottom panel; wherein said two flaps fold over and attach to the exterior side of said top panel via attaching mechanisms located on the exterior side of said top panel wherein said flaps close said spectacle case; and Wherein said sheet further comprises;

At least one of a plurality of cutouts in the material of said sheet located down a center vertical axis of the middle portion of said sheet, wherein said cutouts reduces the amount of material in said middle portion of said sheet, wherein said case will fold in half down a center vertical axis easier, increasing portability in a pocket or purse; and Wherein said cutouts includes at least one of;

(A) An upper nose bridge indentation located in the middle of said horizontal axis between said top panel and said bottom panels, wherein said upper nose bridge indentation mimics the contours of the space between the lenses above the nose bridge section of said spectacle frame, when said top and said bottom panels are folded over said horizontal axis;

(B) A lower nose bridge indentation located in the middle of the end of said top panel, wherein said lower nose bridge indentation mimics the contours of the space between the lenses of said spectacle frame below the nose bridge section of said spectacle frame, when said top and said bottom panels are folded over said horizontal axis;

(C) A lower nose bridge indentation located in the middle of the end of said bottom panel, wherein said lower nose bridge indentation mimics the contours of the space between the lenses of said spectacle frame below the nose bridge section of said spectacle frame, when said top and said bottom panels are folded over said horizontal axis; and (D) A space between said left and said right flaps that separates said flaps wherein they form two individual flaps instead of a singular flap on said bottom panel; and Wherein said space between said left and said right flaps is definitely one of said cutouts in said material of said sheet.

2. The spectacle eyeglass case defined in claim 1 wherein said flat sheet further comprises at least one of a plurality of layers including;

(A) An exterior fashionable side, (B) An interior non-abrasive soft liner side that is capable of cleaning the lenses of said spectacle frame, and (C) A padded cushion layer between the exterior & interior layers.

3. The spectacle eyeglass case defined in claim 2 further comprising;

A strap that extends out from at least one of the top or bottom panels in the middle section of said top or bottom panel that loops over at least one of the closed temple bows of said spectacle frame and fastens to an attaching mechanism on the exterior side of the top panel.

4. The strap defined in claim 3 comprising at least one of being;

(A) Removable & re-attachable to said case on both ends of said strap, and (B) Adjustable in length.

5. The spectacle eyeglass case defined in claim 1 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right flaps are in a closed position.

6. The spectacle eyeglass case defined in claim 2 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right flaps are in a closed position.

7. The spectacle eyeglass case defined in claim 3 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right flaps are in a closed position.

8. The spectacle eyeglass case defined in claim 4 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right flaps are in a closed position.

9. The spectacle eyeglass case defined in claim 1 further comprising;

A strap that extends out from at least one of the top or bottom panels in the middle section of said top or bottom panel that loops over at least one of the closed temple bows of said spectacle frame and fastens to an attaching mechanism on the exterior side of the top panel.

10. The strap defined in claim 9 comprising at least one of being;

(A) Removable & re-attachable to said case on both ends of said strap, and (B) Adjustable in length.

11. The spectacle eyeglass case defined in claim 9 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right, flaps are in a closed position.

12. The spectacle eyeglass case defined in claim 10 further comprising at least one of;

(A) A clipping device attached to the case; and (B) A mechanism such as a clipping device, Velcro, button, or snap that will hold the case closed in half along said vertical center axis, after said top and bottom panels are folded over said horizontal axis and said left and right flaps are in a closed position.

13. The spectacle eyeglass case defined in claim 5 further comprising;

A tab on at least one side of said top or said bottom panel with a hole in it for receiving an attaching device such as a chain to attach said clipping device.

14. The spectacle eyeglass case defined in claim 6 further comprising;

A tab on at least one side of said top or said bottom panel with a hole in it for receiving an attaching device such as a chain to attach said clipping device.

15. The spectacle eyeglass case defined in claim 7 further comprising;

A tab on at least one side of said top or said bottom panel with a hole in it for receiving an attaching device such as a chain to attach said clipping device.

16. The spectacle eyeglass case defined in claim 8 further comprising;

A tab on at least one side of said top or said bottom panel with a hole in it for receiving an attaching device such as a chain to attach said clipping device.

17. The spectacle eyeglass case defined in claim 11 further comprising;

A tab on at least one side of said top or said bottom panel with a hole in it for receiving an attaching device such as a chain to attach said clipping device.

18. The spectacle eyeglass case defined in claim 12 further comprising;

A tab on at least one side of said top or said bottom panel with a hole in it for receiving an attaching device such as a chain to attach said clipping device.

* * * * *